United States Patent [19]

Lew

[11] Patent Number: 4,640,053

[45] Date of Patent: Feb. 3, 1987

[54] EDGE REINFORCED CABINET DOOR WITH BUILT-IN DOOR HARDWARES

[76] Inventor: Hyok S. Lew, 7890 Oak St., Arvada, Colo. 80005

[21] Appl. No.: 764,888

[22] Filed: Aug. 12, 1985

[51] Int. Cl.[4] ..... E06B 3/00

[52] U.S. Cl. ..... 49/501; 52/823; 49/460

[58] Field of Search ..... 49/501, 460, 462, 388, 49/410, 411; 52/823

[56] References Cited

U.S. PATENT DOCUMENTS

| | | | |
|---|---|---|---|
| 3,271,919 | 9/1966 | Olton | 52/823 |
| 3,396,490 | 8/1968 | Dukas | 49/388 X |
| 4,245,614 | 1/1981 | Hurwitz | 49/410 X |
| 4,377,055 | 3/1983 | Frederick | 49/388 |

FOREIGN PATENT DOCUMENTS

| | | | |
|---|---|---|---|
| 258999 | 4/1965 | Australia | 52/823 |

*Primary Examiner*—Kenneth Downey

[57] ABSTRACT

This invention relates to wooden cabinet doors with two edges reinforced with aluminum or plastic extrusions fitted along the edge of the wooden door in a sliding method and secured thereon by means of bonding or glueing, wherein the aluminum or plastic extrusions reinforcing the edges of the cabinet door provide built-in door hard-wares such as the hinge pin retaining means in case of the swinging doors and the slide guide means in case of the sliding doors.

7 Claims, 7 Drawing Figures

EDGE REINFORCED CABINET DOOR WITH BUILT-IN DOOR HARDWARES

BACKGROUND OF THE INVENTION

As the wooden furniture manufacturing process becomes more and more mechanized and automated, the expense of making and installing cabinet doors has become a significant portion of the furniture cost. With few exceptions, the cabinet doors included in all types of the present day wooden furnitures still employ pivoting hinges or slide rails constructed and arranged in essentially the same way as they have been done for hundreds of years in the past.

The primary object of the present invention is to provide means for reinforcing two edges of wooden cabinet doors parallel to the pivoting axis in the case of the swinging doors and perpendicular to the direction of the sliding movements in the case of the sliding doors, which means provides built-in door hardwares such as the hinge pin retaining means in case of the swinging doors and the slide guide means in case of the sliding doors.

Another object is to provide wooden cabinet doors with two edges reinforced with aluminum or plastic extrusions wherein a first aluminum or plastic extrusion fitted along a first edge in a sliding method provides a handle means built therein, while a second aluminum or plastic extrusion fitted along a second edge in a sliding method provides a hinge pin retaining means in the case of the swinging doors and slide guide means in the case of the sliding doors which means are built in the second aluminum or plastic extrusion.

A further object is to provide wooden cabinet doors of contemporary appearance exclusively designed for the automated manufacturing process.

These and other objects of the present invention will become clear as the description thereof proceeds.

BRIEF DESCRIPTION OF THE FIGURES

The present invention may be described with great clarity and specificity by referring to the following figures.

DESCRIPTION OF THE ILLUSTRATED EMBODIMENTS

Figure 1:
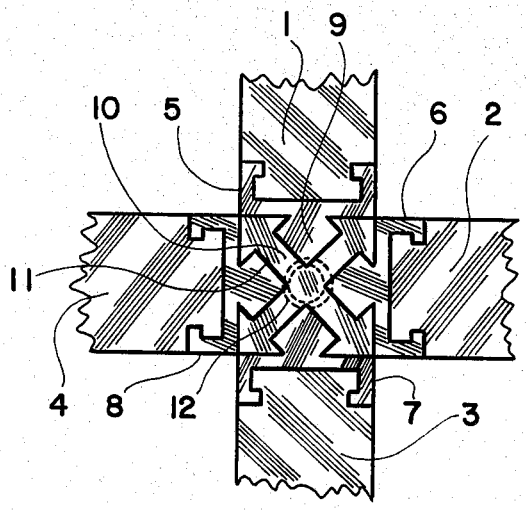
FIG. 1 illustrates an end view of four boards connected in a cross connection by a slide connector system.

In FIG. 1 there is illustrate an end view of four boards 1, 2, 3, and 4 connected to each other in a cross connection by a slide connector system that was invented jointly by the inventor of the present invention and his colleague, which invention is described in patent application Ser. No. 465,108 entitled "Slide Connectors with Locking Means" that is allowed for U.S. patent. The extremities of the boards 1, 2, 3 and 4 connected to each other include a aluminum or plastic extrusions 5, 6, 7 and 8, respectively, wherein each of which extrusions has a substantially C-shaped cross section including a slide rail 9 that has a substantially pointed ridge and a narrowed-down root. The aluminum or plastic extrusions 5, 6, 7 and 8 are respectively fitted along the extremities of the hoards 1, 2, 3 and 4 in a sliding method and secured thereto by means of bonding or glueing. The slide connector 10 is an aluminum or plastic extrusion having a square cross section that includes four retaining slide grooves such as the element 11 respectively disposed on four sides of the aluminum or plastic extrusion, wherein those grooves with a narrowed-down opening open to the sides of the aluminum or plastic extrusion have a cross section matched to the cross section of the slide rail 9 affixed to the extremity of the board. One extremity of the slide connector 10 that is opposite to the extremity shown in FIG. 1 includes a centrally disposed threaded hole 12 having a diameter slightly greater than the distance between the bottoms of two opposite slide grooves included therein. A screw such as a set screw threadedly engaging the threaded hole 12 interferes with the ridges of the slide rails and, consequently, the four boards 1, 2, 3 and 4 connected by the slide connector 10 become locked in position. Of course, it is evident that the slide connector system with locking means illustrated in FIG. 1 can be used for a T-connection of three boards and L-connection of two boards wherein the unused slide grooves may be filled up with filler members extruded in aluminum or plastic.

Figure 2:
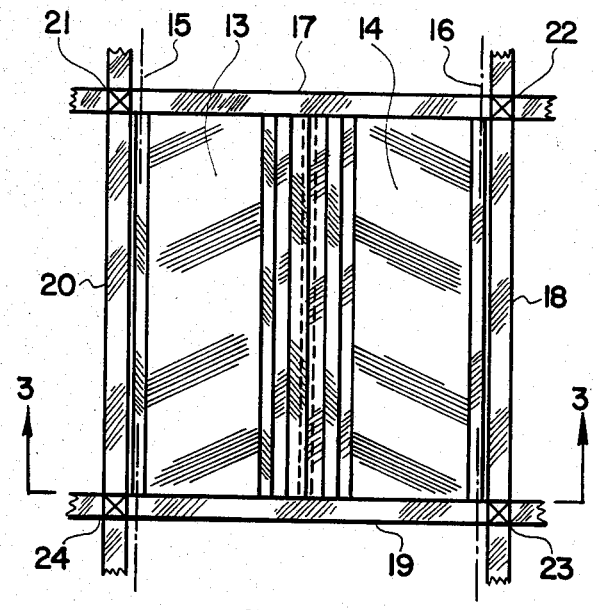
FIG. 2 illustrates a front view of a portion of a furniture including a pair of swinging doors.

In FIG. 2 there is illustrated a front view of a portion of a furniture including a pair of swinging doors 13 and 14 pivotable about the pivoting axis 15 and 16, respectively. The side walls of the cabinet compartment comprises four boards 17, 18, 19 and 24 assembled and secured by means of four slide connectors with locking means 21, 22, 23 and 24, each of which is constructed in essentially the same way as the arrangement shwon in FIG. 1.

Figure 3:
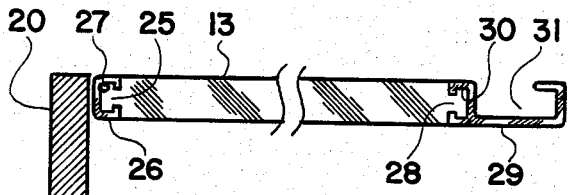
FIG. 3 illustrates a cross section of the furniture shown in FIG. 2, which cross section is taken along plane 3—3 as shown in FIG. 2.

In FIG. 3 there is illustrated an end view of one extremity of the swinging door 13 viewed across a plane 3—3 as shown in FIG. 2. The first edge 25 is reinforced with an elongated member 26 of an aluminum or plastic extrusion having a substantially flattened U-shaped cross section including a retaining groove with a narrowed-down opening, that is fitted along the first edge of the door by a sliding method end secured thereto by bonding or glueing. A hole 27 disposed close to the one corner of the end section of the door, which corner is adjacent to the front face of the cabinet assembly, rotatably or nonrotatably receives a hinge pin wherein the hinge pin extending therefrom engages a match-drilled hole into the board 19 as shown in FIG. 2. The other end of the door 13 opposite to one end shown in FIG. 3 includes another hole drilled in line with the hole 27 that receives another hinge pin. The second edge 28 of the door 13 is reinforced with another elongated member 29 of an aluminum or plastic extrusion including a retaining groove with a narrowed-down opening 30 and a handle groove 31 with an opening open through a plane including one face of the door closest to the hinge hole 27.

Figure 4:
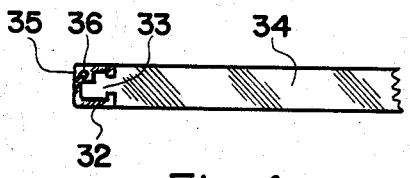
FIG. 4 illustrates an end view of another embodiment of the swinging cabinet doors including built-in hinge pin retaining means.

In FIG. 4 there is illustrated another embodiment of the elongated member 32 including a retaining groove with a narrowed-down opening that is employed in reinforcing the first edge 33 of a swinging cabinet door 34. One corner 35 in the cross section of the elongated member 32 is built-up in thickness in order to accommodate the hinge hole 36 therein. The hinge hole 36 may have a finite depth as it is drilled after extruding the elongated member 32 or it may be a through hole as it is formed integrally in the process of the extrusion through an extrusion die including a provision providing the hinge hole 36. The second edge of the door 34 parallel to the first edge 33, which is not shown in FIG. 4, is reinforced by an elongated member including a handle groove as shown in FIG. 3

Figure 5:
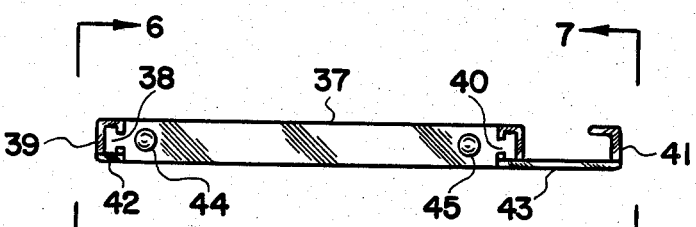
FIG. 5 illustrates an end view of a sliding cabinet door with reinforced edges providing a built-in slide guide means.

In FIG. 5 there is illustrated an extremity of sliding cabinet door 37 wherein first edge 38 is reinforced with an elongated member 39 including a retaining groove with a narrowed-down opening and the second edge 40 is reinforced with another elongated member 41 including a retaining groove with a narrowed-down opening and a handle groove, which elongated members are constructed in essentially the same cross sections as described in conjunction with FIG. 3. Both extremities of the elongated reinforcing member 39 are cut flush to the end of the cabinet door 37 only in part in such a way that a planar member 42 of a finite length extends from each end of the elongated reinforcing member 39. Both extremities of the elongated reinforcing member 41 are similarly prepared wherein a planar member 43 of a finite length extends from each end of the elongated reinforcing member 41. The planar members of finite length 42 and 43 are disposed on a substantially common plane substantially coinciding with the inside face of the cabinet door. A pair of slide bearings 44 and 45 such as thumb tacks are affixed to each end face of the cabinet door in order to enhance the sliding movement of the sliding door.

Figure 6:
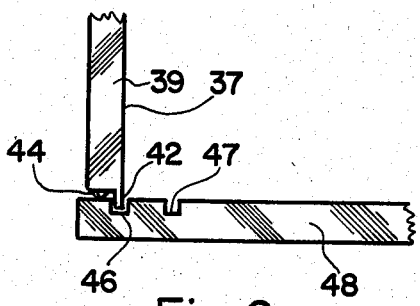
FIG. 6 illustrates an end view of the first reinforced edge of the sliding cabinet door shown in FIG. 5 that is viewed across plane 6—6 as shown in FIG. 5.

In FIG. 6 there is illustrated the first reinforced edge of the cabinet door 37 viewed across a plane 6—6 as shown in FIG. 5. One extremity of the elongated reinforcing member 39 includes a planar member of finite length or slide guide 42 that engages one of two slide grooves 46 and 47 formed in the top surface of the bottom board 48 constituting a cabinet in a sliding relationship. The slide bearing 44 in contact with the top surface of the bottom board 48 enhances the sliding movement of the sliding door relative to the bottom board 48. The other extremity of the elongated reinforcing member 39 includes a slide guide slidably engaging one of two slide grooves formed in the bottom surface of the top boards constituting the cabinet. The top end of the cabinet door 37 may or may not include slide bearings such as the elements 44 and 45 included in the bottom end thereof.

Figure 7:
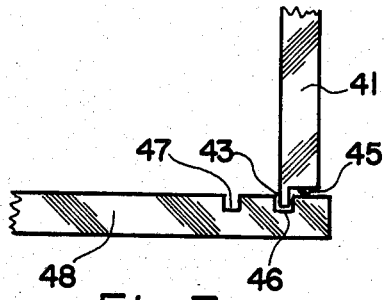
FIG. 7 illustrates an end view of the second reinforced edge of the sliding cabinet door shown in FIG. 5, that is viewed across palne 7—7 as shown in FIG. 5.

In FIG. 7, there is illustrated the second reinforced edge of the cabinet door 37 viewed across a plane 7—7 as shown in FIG. 5. The slide guide 43 built into the end of the elongated reinforcing member 41 guides the sliding door 37 following one of two slide grooves 46 and 47 disposed in the surface of the board 48, while the slide bearing 45 enhances the sliding movement of the sliding door relative to the board 48. Of course, cabinet door systems including more than two sliding doors must have more than two slide grooves. In place of the slide bearing of construction similar to a thumb tack, a plastic or metalic tape or strip affixed to the end face of the sliding door and/or to the surface of the board under sliding contact with the sliding door may be employed.

While the principles of the present invention have now been made clear by the illustrative embodiments, there will be immediately obvious to those skilled in the art many modifications of the structures, arrangements, proportions, elements, materials and components which are particularly adapted for the specific working environments and operating conditions in the practice of the invention without departing from those principles.

I claim:

1. An edge reinforced cabinet door comprising in combination;

(a) a cabinet door;

(b) a first elongated reinforcing member having lengthwise disposed retaining groove with a narrowed-down opening, said first elongated reinforcing member fitted along a first edge of said cabinet door by a sliding method and secured nonslidably to said first edge wherein said first edge includes a lengthwise disposed retaining rail with a cross section substantially matched to the cross section of said retaining groove included in said first elongated reinforcing member;

(c) a second elongated reinforcing member having a lengthwise disposed retaining groove with a narrowed-down opening, said second elongated reinforcing member fitted along a second edge of said cabinet door parallel and opposite to said first edge by a sliding method and secured nonslidably to said second edge wherein said second edge includes a lengthwise disposed retaining rail with a cross section substantially matched to the cross section of said retaining groove included in said second elongated reinforcing member, said second elongated reinforcing member further including a handle groove with an opening open through a plane substantially including one side surface of said cabinet door;

(d) a first hole disposed in one end of said cabinet door substantially perpendicular to said first and second edges substantially through said cabinet door material adjacent to one reinforced corner in the cross section of said edge reinforced cabinet door in a direction substantially parallel to the length of said first elongated reinforcing member wherein said one reinforced corner includes said first elongated reinforcing member and further includes substantially said one side surface of said cabinet door; and (e) a second hole disposed in the other end of said cabinet door opposite and parallel to said one end substantially through said cabinet door material substantially in line with said first hole and adjacent to said one reinforced corner in the cross section of said edge reinforced cabinet door.

2. The combination as set forth in claim 1 wherein a first hinge pin engaging and extending from said first hole and a second hinge pin engaging and from said second hole are included.

3. An edge reinforced cabinet door comprising in combination:

(a) a cabinet door;

(b) a first elongated reinforcing member having lengthwise disposed retaining groove with a narrowed-down opening, said first elongated reinforcing member fitted along a first edge of said cabinet door by a sliding method and secured nonslidably to said first edge wherein said first edge includes a lengthwise disposed retaining rail with a cross section substantially matched to the cross section of said retaining groove included in said first elongated reinforcing member;

(c) a second elongated reinforcing member having a lengthwise disposed retaining groove with a narrowed-down opening, said second elongated reinforcing member fitted along a second edge of said cabinet door parallel and opposite to said first edge by a sliding method and secured nonslidably to said second edge wherein said second edge includes a lengthwise disposed retaining rail with a cross section substantially matched to the cross section of said retaining groove included in said second elongated reinforcing member, said second elongated reinforcing member further including a handle groove with an opening open through a plane substantially including one side surface of said cabinet door;

(d) a first hole disposed in one extremity of said first elongated reinforcing member through said first elongated reinforcing member material adjacent to one corner in the cross section of said first elongated reinforcing member in a direction substantially parallel to the length of said first elongated reinforcing member wherein said one corner substantially includes said one side surface of said cabinet door; and (e) a second hole disposed in the other extremity of said first elongated reinforcing member opposite to said one extremity through said first elongated reinforcing member material substantially in line with said first hole and adjacent to said one corner in the cross section of said first elongated reinforcing member.

4. The combination as set forth in claim 3 wherein a first hinge pin engaging and extending from said first hole and a second hinge pin engaging and extending from said second hole are included.

5. An edge reinforced cabinet door comprising in combination:

(a) a cabinet door;

(b) a first elongated reinforcing member having lengthwise dispsed retaining groove with a narrowed-down opening, said first elongated reinforcing member fitted along a first edge of said cabinet door by a sliding method and secured nonslidably to said first edge wherein said first edge includes a lengthwise disposed retaining rail with a cross section substantially matched to the cross section of said retaining groove included in said first elongated reinforcing member;

(c) a second elongated reinforcing member having a lengthwise disposed retaining groove with a narrowed-down opening, said second elongated reinforcing member fitted along a second edge of said cabinet door parallel and opposite to said first edge by a sliding method and secured nonslidably to said second edge wherein said second edge includes a lengthwise disposed retaining rail with a cross section substantially matched to the cross section of said retaining groove included in said second elongated reinforcing member, said second elongated reinforcing member further including a handle groove with an opening open through a plane substantially including one side surface of said cabinet door;

(d) one extremity of said first elongated reinforcing member partially substantially cut off substantially flush to one end of said cabinet door and shaped to provide a substantially flat slide guide of finite length disposed on a plane substantially parallel to said one side surface of said cabinet door and extending from said one extremity, and the other extremity of said first elongated reinforcing member opposite to said one extremity partially cut off substantially flush to the other end of said cabinet door opposite to said one end and shaped to provide a substantially flat slide guide of finite length disposed on said plane substantially parallel to said one side surface of said cabinet door and extending from said the other extremity; and (e) one extremity of said second elongated reinforcing member partially cut off substantially flush to said one end of said cabinet door and shaped to provide a substantially flat slide guide of finite length disposed on said plane substantially parallel to said one side surface of said cabinet door and extending from said one extremity, and the other extremity of said second elongated reinforcing member partially cut off substantially flush to said the other end of said cabinet door and shaped to provide a substantially flat slide guide of finite length disposed on said plane substantially parallel to said one side surface of said cabinet door and extending from said the other extremity.

6. The combination as set forth in claim 5 wherein said one end of said cabinet door includes at least one slide bearing affixed to said one end.

7. The combination as set forth in claim 6 wherein said other end of said cabinet door includes at least one slide bearing affixed to said the other end.

* * * * *